US007270609B2

(12) United States Patent
Yamaguchi et al.

(10) Patent No.: US 7,270,609 B2
(45) Date of Patent: Sep. 18, 2007

(54) GOLF PUTTER HEAD

(75) Inventors: Tetsuo Yamaguchi, Kobe (JP); Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/885,787

(22) Filed: Jul. 8, 2004

(65) Prior Publication Data

US 2005/0020381 A1 Jan. 27, 2005

(30) Foreign Application Priority Data

Jul. 23, 2003 (JP) ..... 2003-278364

(51) Int. Cl.
*A63B 53/04* (2006.01)

(52) U.S. Cl. ..... 473/341; 473/350

(58) Field of Classification Search ..... 473/324–350
See application file for complete search history.

(56) References Cited

U.S. PATENT DOCUMENTS 4,741,535 A * 5/1988 Leonhardt ..... 473/252
6,325,728 B1 * 12/2001 Helmstetter et al. ..... 473/328
6,435,980 B1 * 8/2002 Reyes et al. ..... 473/324
6,471,604 B2 * 10/2002 Hocknell et al. ..... 473/334
6,475,102 B2 * 11/2002 Helmstetter et al. ..... 473/344
6,607,452 B2 * 8/2003 Helmstetter et al. ..... 473/345
6,814,674 B2 * 11/2004 Clausen et al. ..... 473/342

FOREIGN PATENT DOCUMENTS

JP 2613849 B2 2/1997
JP 2001137392 A * 5/2001

* cited by examiner

*Primary Examiner*—Eugene Kim
*Assistant Examiner*—Alvin A Hunter
(74) *Attorney, Agent, or Firm*—Birch, Stewart, Kolasch & Birch, LLP

(57) ABSTRACT

The present invention is a golf putter head wherein the second moment among the three inertial moments described below shows a minimum value in a state in which the head is placed on a horizontal plane at a specified lie angle and loft angle:

First moment: inertial moment of the head about a first axis which passes through the center of gravity of the head, and which is parallel to the face surface and said horizontal plane;

Second moment: inertial moment of the head about a second axis which is an axis in the vertical direction that passes through the center of gravity of the head; and Third moment: inertial moment of the head about a third axis which passes through the center of gravity of the head, and which is perpendicular to said first axis and perpendicular to said second axis.

5 Claims, 8 Drawing Sheets

GOLF PUTTER HEAD

This Non-provisional application claims priority under 35 U.S.C. § 119(a) on Patent Application No(s). 2003-278364 filed in JAPAN on Jul. 23, 2003, the entire contents of which are hereby incorporated by reference.

BACKGROUND OF THE INVENTION

1. Field of the Invention

The present invention relates to a golf putter head.

2. Description of the Related Art

Golf putters are golf clubs that are used mainly to cause the ball to roll on the green and enter the cup. The shapes of such golf putter heads include various types of shapes such as the so-called toe-heel balance type, L type, mallet type, T type and the like. These head shapes include shapes that are devised in visual terms from the standpoint of facilitating stance and the like, and shapes that reduce rotation of the head during hitting and broaden the sweet area by concentrating the weight on the toe side and heel side of the head (for example, see Japanese Patent No. 2613849).

In the hitting of the ball by a golf putter, i.e., in putting, a much more delicate feeling is required than is needed in the hitting of the ball by other clubs, such as so-called driver shots or iron shots. Putting does not involve hitting the ball with a large force as in shots made with other clubs, but instead involves hitting the ball with a relatively short swing and a small force; accordingly, the effect of the delicate feeling on the results is relatively large. Furthermore, since putting involves hitting the ball while aiming at a small cup on a green with a complicated slope, the ball will miss the small cup if there is even a slight error in the direction or speed of the shot. The reason for this is that track along which the ball rolls over the green varies minutely according to the initial speed and hitting direction of the ball, and also according to the fastness, slope and the like of the green. It is necessary to rely on a delicate feeling in order to achieve accurate control of the hitting direction and hitting speed while accurately grasping these various conditions. Accordingly, it is important that the feeling of the putting swing (hereafter also referred to as the "stroke" or the like) be good.

SUMMARY OF THE INVENTION

However, in the case of conventional golf putter heads (hereafter also referred to as "heads" or the like), it has been found that there is room for improvement in the feeling of the swing during putting. Although conventional heads have been designed from the standpoint of facilitating the stance in terms of visual sensory elements, and suppressing the variation in the orientation of the face surface (caused by impact) by means of toe-heel balance and the like so that variation in the hitting of the ball is reduced, the feeling during the swing has not been sufficiently examined. As was described above, the feeling during the swing has a great effect on the results of putting. Accordingly, if this feeling is improved, a golf putter head which offers a high probability of sinking the putt can be obtained. It has now been discovered that a smooth stroke is important for improving this feeling; furthermore, special features of the head for realizing such a smooth stroke have been discovered.

The present invention was devised in light of the above points; it is an object of the present invention to provide a golf putter head that offers a smooth stroke and a good feeling.

The present invention, which is used to achieve the above-mentioned object, is a golf putter head characterized in that the head is set at a weight balance in which the second moment among the three inertial moments defined by (a) through (c) below in a state in which the head is placed on a horizontal plane at a specified lie angle and loft angle, shows a minimum value:

(a) First moment: the inertial moment of the head about a first axis which passes through the center of gravity of the head and is parallel to the face surface and the abovementioned horizontal plane;

(b) Second moment: the inertial moment of the head about a second axis which is an axis that passes through the center of gravity of the head in the vertical direction; and (c) Third moment: the inertial moment of the head about a third axis which passes through the center of gravity of the head, and which is perpendicular to the abovementioned first axis and perpendicular to the abovementioned second axis.

If this is done, the rotation of the head about the second axis is stabilized, and the behavior of the head during the putting stroke is stabilized. In the putting stroke, the head performs a rotational motion along with the translational motion. The main part of this rotational motion of the head is rotation that approximates rotation about the second axis among the abovementioned three axes, i.e., first through third axes. As a result of the second moment among the first through third moments being minimized as described above, the rotation about the second axis which is reference axis of this second moment is stabilized; as a result, the rotation of the head during the stroke is stabilized, so that the behavior of the head is stabilized. This effect has been confirmed by embodiments, and it has been demonstrated that there are theoretical grounds for this effect. These points will be described later.

Furthermore, it is desirable that the value obtained by subtracting the smaller inertial moment of the first and third moments from the second moment be 250 $g \cdot cm^2$ or greater, it is even more desirable that this value be 400 $g \cdot cm^2$ or greater, and it is especially desirable that this value be 900 $g \cdot cm^2$ or greater. If this is done, the rotation of the head about the second axis is stabilized even further; accordingly, the behavior of the head during the stroke is stabilized even further. Furthermore, if the second moment is 1000 $g \cdot cm^2$ or greater, the head shows less tendency to rotate about the second axis. Accordingly, variations in the face orientation caused by impact with the ball are suppressed, so that the directionality is stabilized, and the sweet area is broadened. Moreover, in cases where the face surface of the head is not planar, "face surface" in the definition of the abovementioned first axis is replaced by "plane passing through a total of three points, i.e., two points at both ends of the edge line of the leading edge, and a point that divides the edge line that distinguishes the top surface and face surface of the head into two equal parts".

DESCRIPTION OF THE PREFERRED EMBODIMENTS

Figure 1:
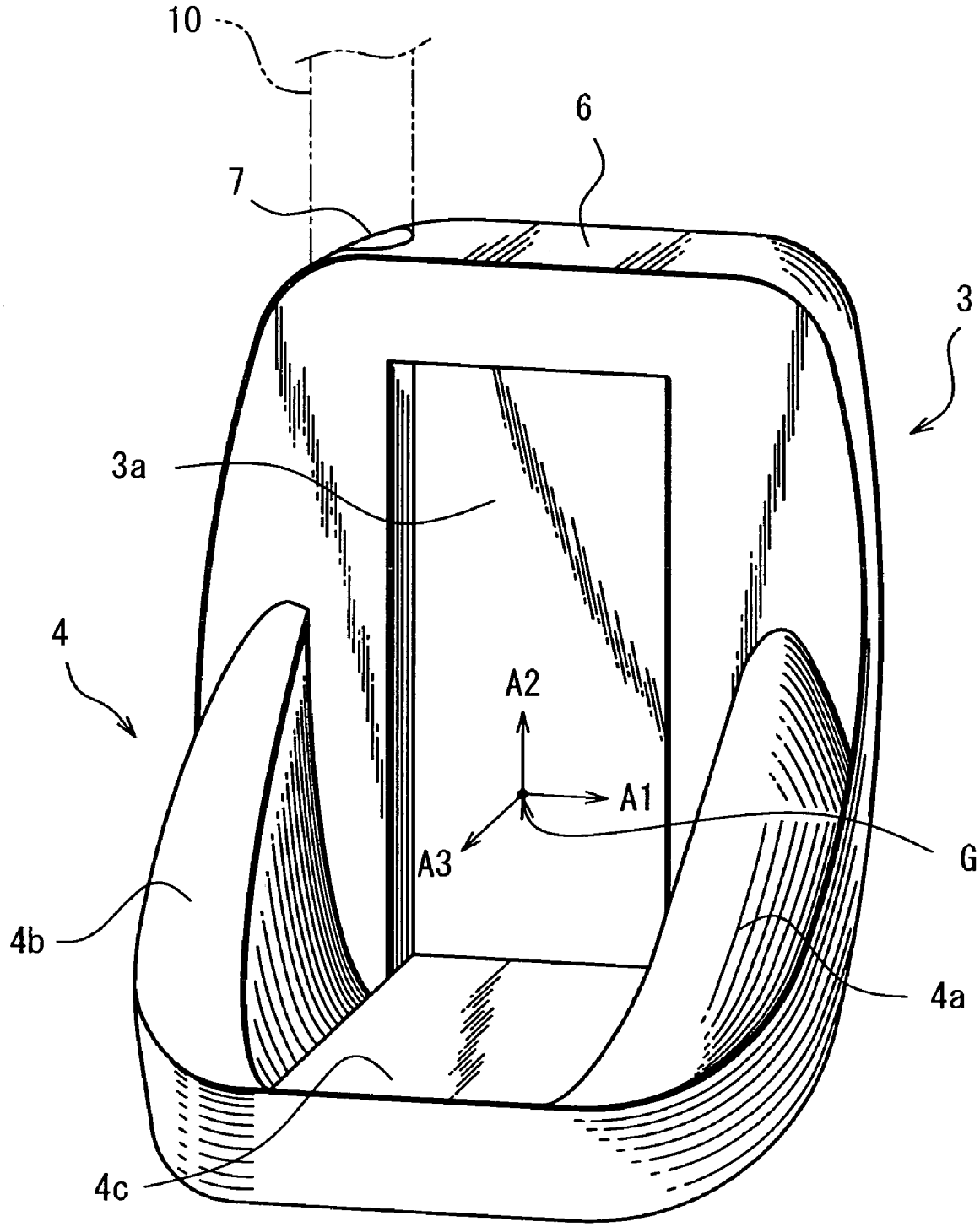
FIG. 1 is a perspective view of a golf putter head in one embodiment of the present invention as seen from the side of the back face.
Figure 2:
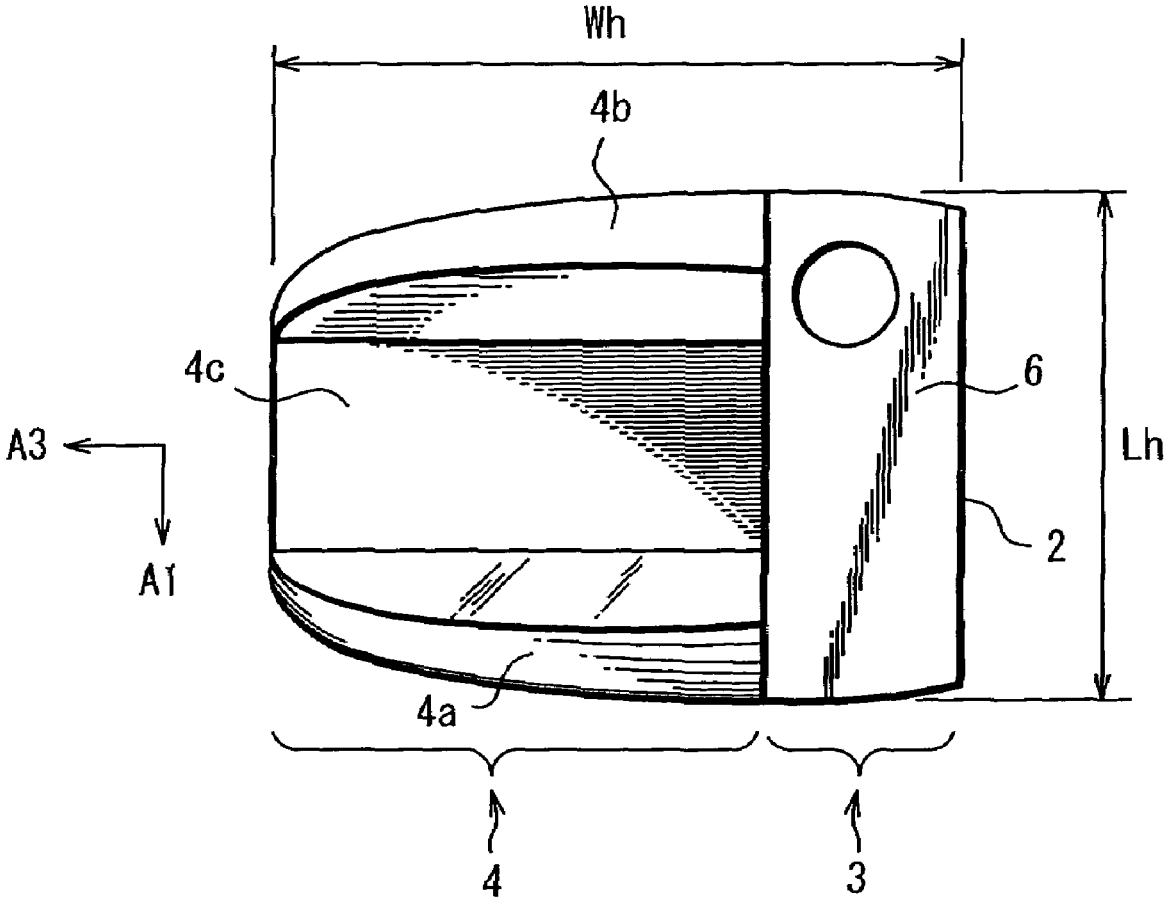
FIG. 2 is a plan view of a golf putter head in one embodiment of the present invention as seen from above.
Figure 3:
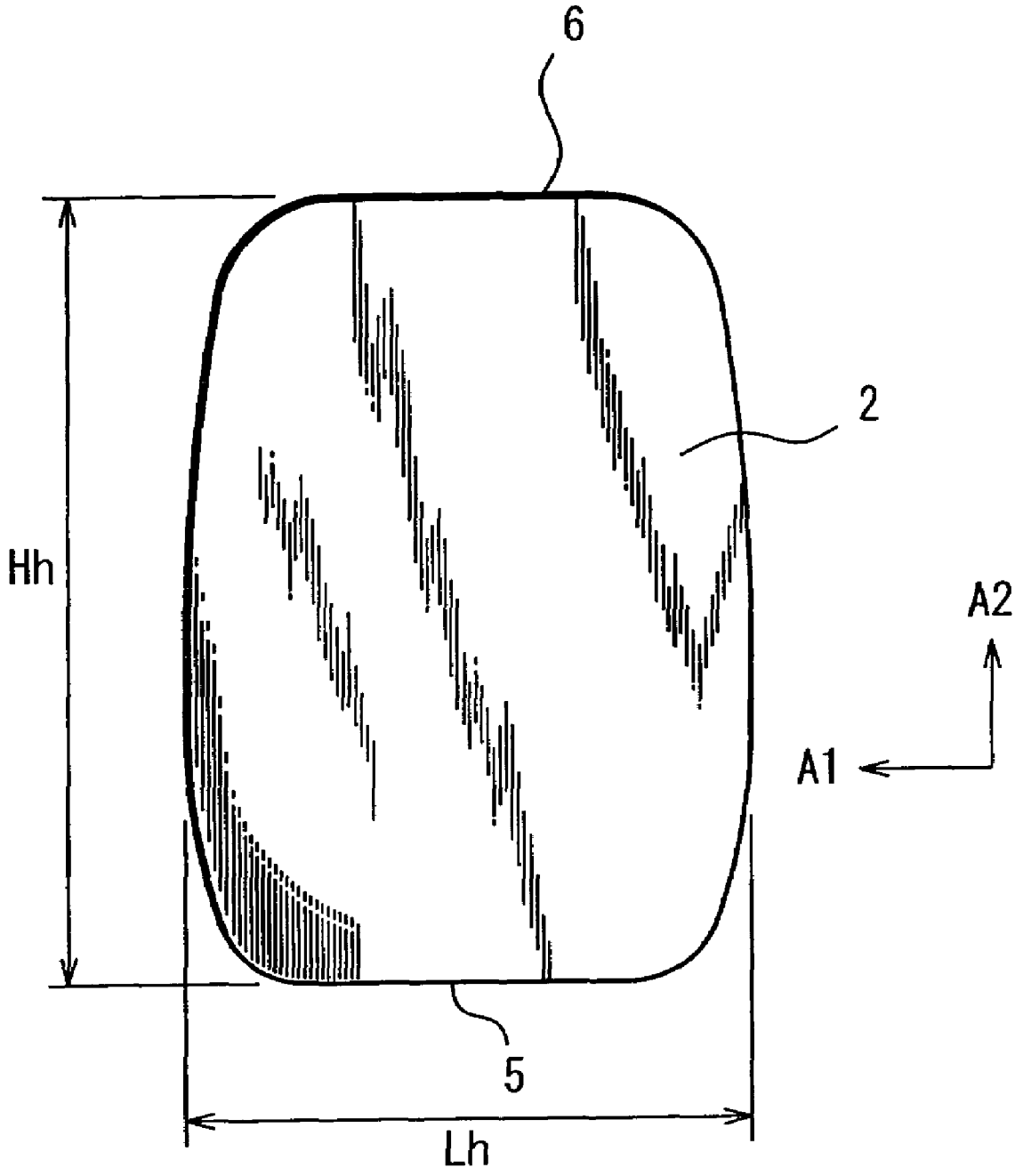
FIG. 3 is a front view of a golf putter head in one embodiment of the present invention as seen from the side of the face surface.
Figure 4:
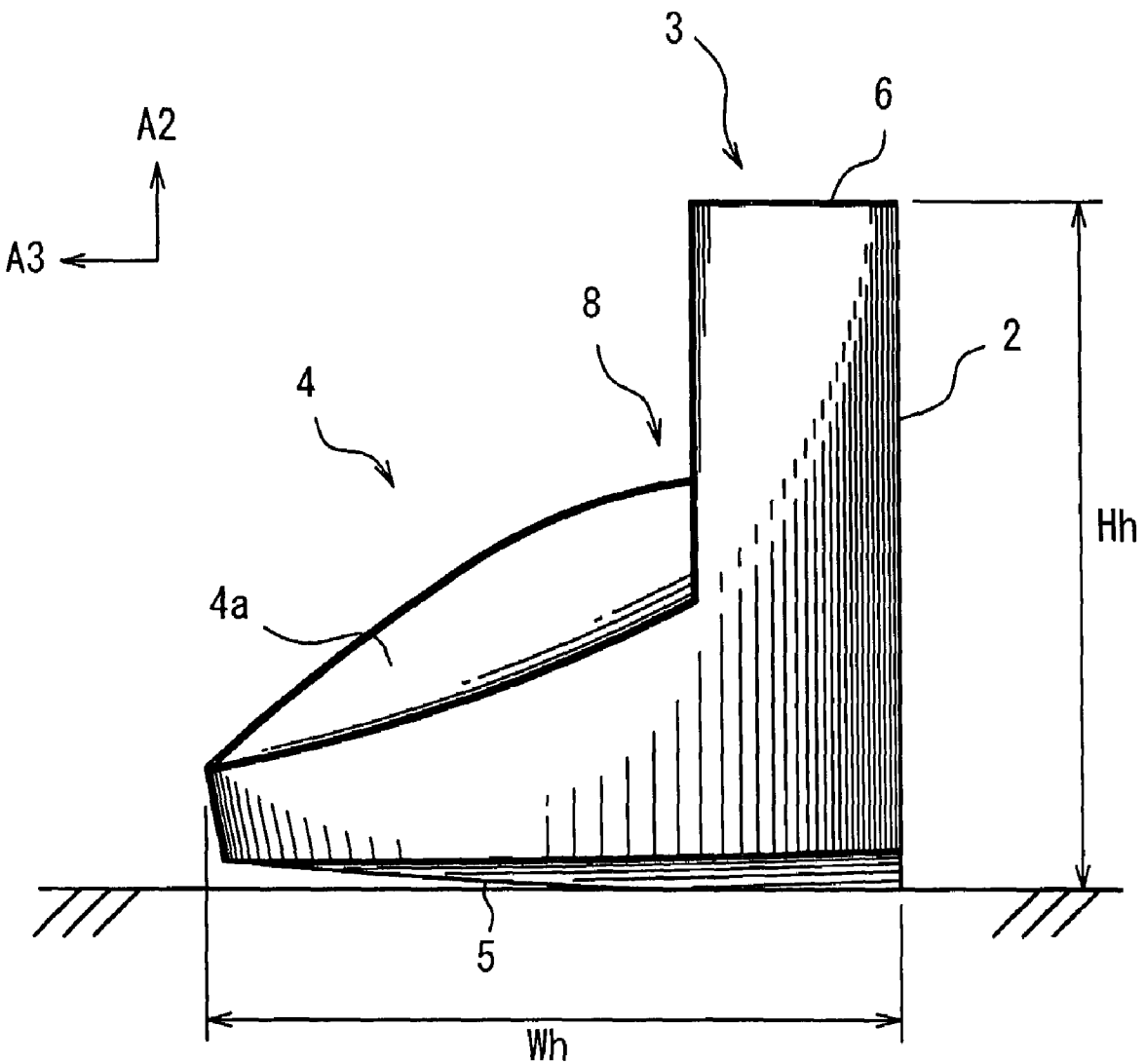
FIG. 4 is side view of a golf putter head in one embodiment of the present invention as seen from the toe side.
Figure 5:
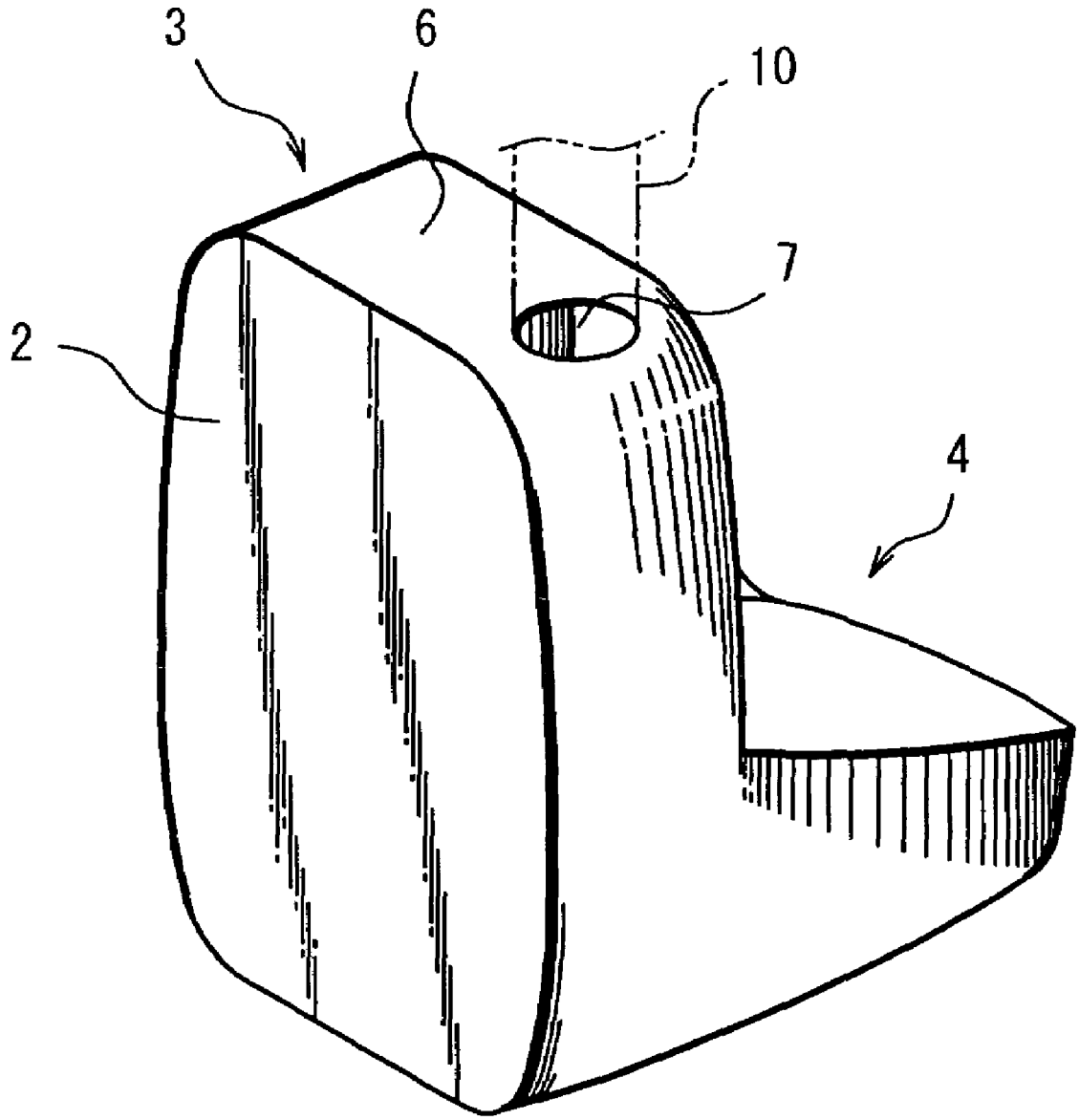
FIG. 5 is a perspective view of a golf putter head in one embodiment of the present invention as seen from the side of the face surface.

An embodiment of the present invention will be described below with reference to the attached figures. FIGS. 1 through 5 illustrate a golf putter head constituting one embodiment of the present invention. FIG. 1 is a perspective view seen from the side of the back face, FIG. 2 is a plan view (a view of the head as seen from above), FIG. 3 is a front view seen from the side of the face surface 2, FIG. 4 is a side view (a view of the head as seen from the toe side), and FIG. 5 is a perspective view seen from the side of the face surface 2, which is the surface that hits the ball.

As is shown in FIGS. 1 and 5, this head comprises a substantially thick plate-form front part 3 whose foremost surface is a planar face surface 2, which is the surface that hits the ball, and a rear part 4 which extends rearward toward the back face from the rear of this front part 3. The front part 3 and rear part 4 form an integral unit. As is shown in FIG. 3, the face surface 2 is formed with a rectangular shape which is long in the vertical direction (i.e., in which the head height Hh, which is the dimension in the top-sole direction, is greater than the head length Lh, which is the dimension in the toe-heel direction), and in which the four corners are rounded. The bottom surface of the front part 3 and that of the rear part 4 are continuously connected so as to form a sole surface 5 with a substantially smooth curved surface as a whole (see FIG. 4). As is shown in FIG. 4, since the height of the rear part 4 is lower than the height of the front part 3, a large step 8 is formed in the boundary area between the front part 3 and rear part 4. Furthermore, a shaft hole 7 (see FIG. 5) which is used to mount a shaft 10 (indicated by an imaginary line in FIGS. 1 and 5) is formed in a position close to the heel in the top surface 6, which is the upper surface of the front part 3. A shaft 10 is inserted and fastened in this shaft hole 7, so that the club can be used as a golf putter.

As is shown in FIG. 1, the toe portion 4*a* and heel portion 4*b* of the rear part 4 are raised to a relatively large height, and the central portion 4*c* which is positioned between the toe portion 4*a* and heel portion 4*b* is lower than the toe portion 4*a* and heel portion 4*b*. The upper surface of the central portion 4*c* has a flat planar shape; this flat planar portion constitutes the lowermost portion of the upper surface of the head. As is shown in FIG. 2, this flat planar portion is formed with a rectangular shape that is longer in the face—back face direction than in the toe-heel direction. As is shown in FIG. 4, the toe portion 4*a* and heel portion 4*b* of the rear part 4 show a gradual reduction in height from the side of the front part 3 toward the side of the back face. Furthermore, as is shown in FIG. 2, the head width Wh is greater than the head length Lh.

The back surface of the front part 3 on the opposite side from the face surface 2 is connected to the rear part 4; as is shown in FIG. 1, however, a face back surface recess 3*a* is formed in the central portion, and the bottom surface of this face back surface recess 3*a* on the side of the sole surface 5 forms a continuous flat planar surface that is an extension of the flat planar surface of the central portion 4*c* of the rear part 4. Furthermore, the width of the flat planar portion of the central portion 4*c* of the rear part 4 is set so that this width is substantially the same as the width of the face back surface recess 3*a* in the toe-heel direction.

If a golf putter head with such a configuration is formed, the second moment which is the inertial moment about the second axis A2 can be reduced compared to the first moment which is the inertial moment about the first axis A1 and the third moment which is the inertial moment about the third axis A3. Furthermore, in FIGS. 2 through 4, only the directions of the first through third axes A1 through A3 are indicated in order to facilitate understanding; the intersection points of the two axes in each figure do not indicate the center of gravity of the head. Furthermore, the values of the first through third moments can be varied by variously altering the head width Wh, head length Lh, head height Hh, material (specific gravity) of the head main body, presence or absence of a face back surface recess 3*a*, depth and volume of such a recess and the like, and furthermore, in cases where a weight member which has a larger specific gravity than the head main body is disposed, by variously altering the specific gravity, disposition position, weight and the like of this weight member. Furthermore, the values of the first through third moments can also be adjusted by installing an insert formed from a resin, elastomer, rubber, copper or the like in the face surface 2*a*, and variously altering the disposition position, disposition range, specific gravity of the material and thickness of this insert.

Furthermore, the first moment which is the inertial moment about the first axis A1 can be increased by distributing a large weight in positions that are located as far as possible from the first axis A1, and can be reduced by the opposite distribution of weight. For example, the first moment is increased by increasing the size of the head as seen from the toe side or increasing the size of the protruding portion as shown in FIG. 4. For instance, this can be accomplished by increasing the head height Hh or head width Wh. The second moment which is the inertial moment about the second axis A2 can be increased by distributing a large weight in positions that are located as far as possible from the second axis A2, and can be reduced by the opposite distribution of weight. For example, if the size of the head as seen from above is increased as shown in FIG. 2, the second moment is increased. For instance, this can be accomplished by increasing the head width Wh or head length Lh. The third moment which is the inertial moment about the third axis A3 can be increased by distributing a large weight in positions that are located as far as possible from the third axis A3, and can be reduced by the opposite distribution of weight. For example, if the size of the head as seen from the side of the face surface 2 is increased as shown in FIG. 3, the third moment is increased. For instance, this can be accomplished by increasing the head length Lh or head height Hh.

Next, the theoretical grounds of the present invention will be described. Furthermore, the following description relating to Euler's equations of motion (Euler's theorem) is described in "Classical Mechanics—A Modern Perspective" (by V. D. Berger and M. G. Olsson, translated by Morikazu Toda and Yukiko Taue, first printing of first edition Jan. 20, 1975, 17$^{th}$ printing of first edition Nov. 30, 1987) issued by Baifukan K. K. When Euler's equations for a rigid body which has three different main inertial moments are used, the following results are obtained in the motions about the respective axes. In the x axis, y axis and z axis, which are three mutually perpendicular principal axes of inertia, the values of the inertial moments (main inertial moments) about the respective axes are designated as $I_x$, $I_y$ and $I_z$. Furthermore, it is assumed that the inequality $I_x<I_y<I_z$ holds true. Since gravity is a uniform force in the vicinity of the surface of the earth, there is no moment of gravity about the center of gravity of a rigid object. If the moment of the force arising from wind pressure is ignored, then Euler's equations of motion are as shown in the following Equation (1)

$$\left.\begin{aligned} I_x\dot{\omega}_x + (I_z - I_y)\omega_z\omega_y = 0 \\ I_y\dot{\omega}_y + (I_x - I_z)\omega_x\omega_z = 0 \\ I_z\dot{\omega}_z + (I_y - I_x)\omega_y\omega_x = 0 \end{aligned}\right\} \quad (1)$$

Here, $\omega_x$, $\omega_y$, $\omega_z$ are respectively the angular velocity vectors of rotation about the x axis, y axis and z axis, and $\dot{\omega}_x$, $\dot{\omega}_y$, $\dot{\omega}_z$ are respectively the angular acceleration vectors of rotation about the x axis, y axis and z axis.

Here, from the theorem of perpendicular axes, the following Equation (2) holds true.

$$I_z=I_x+I_y \quad (2)$$

If this relational Equation (2) is substituted into Equation (1), and r is set equal to $(I_y-I_x)/(I_y+I_x)$, then the following Equations (3) through (5) are obtained.

$$\dot{\omega}_x+\omega_z\omega_y=0 \quad (3)$$

$$\dot{\omega}_y-\omega_x\omega_z=0 \quad (4)$$

$$\dot{\omega}_z+r\omega_y\omega_x=0 \quad (5)$$

Here, assuming that $I_x$, which is the smallest of $I_x$, $I_y$ and $I_z$, is much smaller than $I_y$, then the approximation of $r\cong 1$ can be used. Hereafter, the qualitative motion properties in a case where this rigid body initially rotates mainly about one of the three principal axes will be determined.

If the initial rotation is about the x axis, then $\omega_z\omega_y$ in Equation (3) can be ignored. Consequently, it is seen that $\omega_x$ is fixed. Specifically, cox is fixed at the initial value $\omega_x(0)$ as shown in the following Equation (6).

$$\omega_x=\omega_x(0) \quad (6)$$

The remaining two Equations (4) and (5) can be solved by introducing a complex variable as shown in the following Equation (7).

$$\tilde{\omega}=\omega_z+i\omega_y \quad (7)$$

Here, $\omega_y=\mathrm{Im}\tilde{\omega}$, and $\omega_z=\mathrm{Re}\tilde{\omega}$.

Furthermore, Im indicates the imaginary part, and Re indicates the real number part.

Accordingly, Equation (4) and Equation (5) respectively become the following Equation (8) and Equation (9). If this Equation (8) and Equation (9) are combined to form a single equation for the complex variable of Equation (7), then Equation (10) holds true. The differential equation expressed by Equation (10) has an exponential function solution as shown by the following Equation (11).

$$Im\dot{\tilde{\omega}}-\omega Re\tilde{\omega}=0 \quad (8)$$

$$Re\dot{\tilde{\omega}}+\omega_x Im\tilde{\omega}=0 \quad (9)$$

$$\dot{\tilde{\omega}}-i\omega_x\tilde{\omega}=0 \quad (10)$$

$$\tilde{\omega}(t)=a\cdot\exp[i(\omega_x t+\alpha)] \quad (11)$$

Accordingly, the corresponding $\omega_y$ and $\omega_z$ can be expressed as follows as functions of the time t:

$$\omega_y(t)=a\cdot\sin(\omega_x t+\alpha) \quad (12)$$

$$\omega_z(t)=a\cdot\cos(\omega_x t+\alpha) \quad (13)$$

Since the amplitude a is small according to the initial conditions, it is seen that the values of the two angular velocity components of Equations (12) and (13) are both consistently small. In the case of such an approximate solution, the following Equations (14) and (15) are obtained.

$$|\tilde{\omega}|=\sqrt{\omega_y(t)^2+\omega_z(t)^2}=a \quad (14)$$

$$\omega=\sqrt{\omega_x(t)^2+\omega_y(t)^2+\omega_z(t)^2}=\sqrt{\omega_x^2+a^2} \quad (15)$$

Accordingly, the angular velocity vector ω shown in the following Equation (16) performs a precession describing a small circular cone about the principal axis x. This is the reason that the rotational motion about the axis x is stabilized.

$$\omega=\omega_x\hat{\imath}+\omega_y\hat{\jmath}+\omega_z\hat{k} \quad (16)$$

Here, $\hat{\imath}$ is a unit vector with a length of 1 that is parallel to the x axis, $\hat{\jmath}$ is a unit vector with a length of 1 that is parallel to the y axis, and $\hat{k}$ is a unit vector with a length of 1 that is parallel to the z axis.

In the case of initial rotation mainly about the z axis, the solution of Euler's equations is similar to the case just treated. In a case where r=1, the mathematical structures of the respective Equations (3), (4) and (5) do not vary even if $\omega_x$ and $\omega_z$ are replaced. Accordingly, the approximate solutions (17) through (19) are obtained in accordance with Equations (6), (12) and (13).

$$\omega_z(t)=\omega_z(0) \quad (17)$$

$$\omega_x(t)=a\cdot\cos(\omega_z t+\alpha) \quad (18)$$

$$\omega_y(t)=a\cdot\sin(\omega_z t+\alpha) \quad (19)$$

In this case as well, the rotational motion about the axis is stable.

However, in a case where the initial rotation is performed about the principal axis of inertia y, the conditions are different. In this case, $\omega_x\omega_z$ in Equation (4) is first ignored, and the following equation is obtained.

$$\omega_y(t)=\omega_y(0) \quad (20)$$

Next, if a sum and difference are created from Equations (3) and (5), the following Equations (21) and (22) are respectively obtained. The first-order coupled solutions of these equations are as shown in Equations (23) and (24). If $\omega_x$ and $\omega_z$ are determined by solving these Equations (23) and (24), then Equations (25) and (26) are obtained.

$$(\dot{\omega}_x+\dot{\omega}_z)+\omega_y(\omega_x+\omega_z)=0 \quad (21)$$

$$(\dot{\omega}_x-\dot{\omega}_z)-\omega_y(\omega_x-\omega_z)=0 \quad (22)$$

$$(\omega_x+\omega_z)=a\cdot\exp(-\omega_y t) \quad (23)$$

$$(\omega_x-\omega_z)=b\cdot\exp(+\omega_y t) \quad (24)$$

$$\omega_x(t)=\tfrac{1}{2}[a\cdot\exp(-\omega_y t)+b\cdot\exp(+\omega_y t)] \quad (25)$$

$$\omega_z(t)=\tfrac{1}{2}[a\cdot\exp(-\omega_y t)-b\cdot\exp(+\omega_y t)] \quad (26)$$

In this motion, the angular velocity about the x axis and z axis abruptly increases as time passes, so that an object constituting a rigid body is upset. Considered in a case in which the object is rotated and projected upward, the solutions clearly given by Equations (20), (25) and (26) is valid only while no great deal of time has passed since the object was projected upward, i.e., only while $\omega_x\omega_z$ can be ignored in Equation (4). Accordingly, the rotational motion of the object about the principal axis of inertia which is such that the inertial moments about the respective axes show maximum or minimum values (among the three principal axes of inertia) is stabilized, while the rotational motions about the other principal axes of inertia are unstable.

Figure 6:
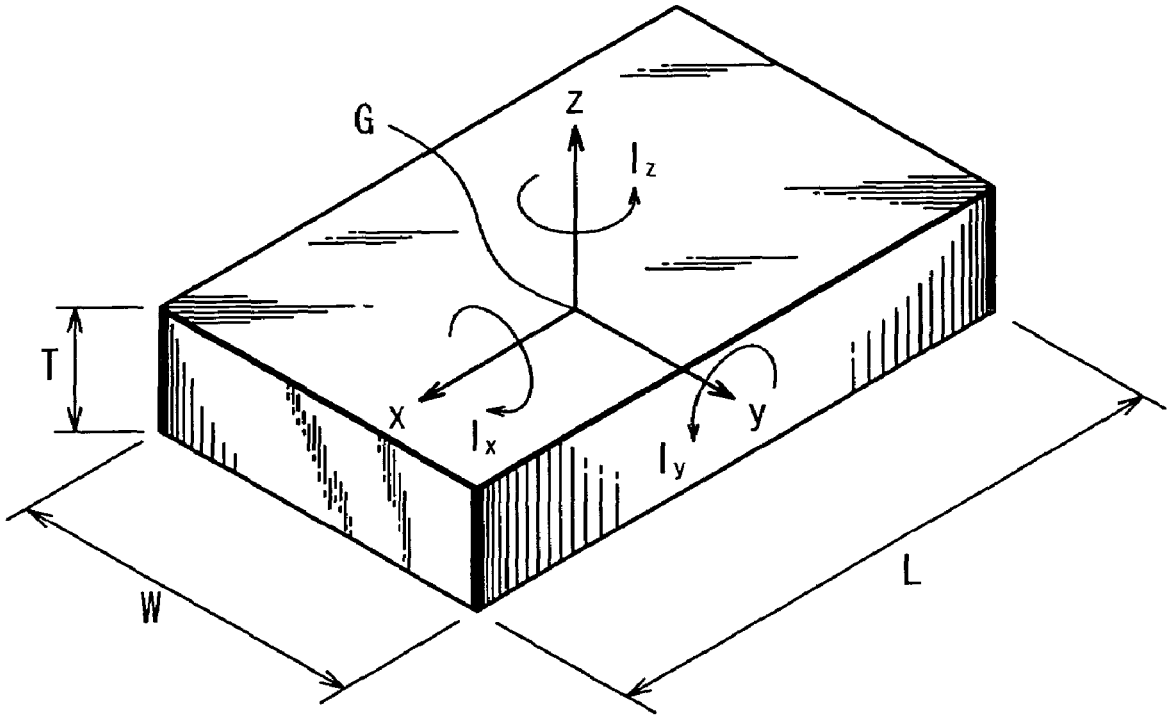
FIG. 6 is a perspective view of a simple model which is used to facilitate understanding of the content of the present invention.

This conclusion may be described as follows using a simple model. As is shown in FIG. 6, a simple (solid) flat plate with a length (in the longitudinal direction) of L, a width of W and a thickness of T is considered as a model. In this model, the inertial moments about the three principal axes of inertia are an inertial moment $I_x$ about the x axis which passes through the center of gravity G of this flat plate, and which is parallel to the upper and lower surfaces of the flat plate and the side surfaces on the long sides, an inertial moment $I_y$ about the y axis which passes through the center of gravity G, and which is parallel to the upper and lower surfaces of the flat plate and perpendicular to the x axis, and an inertial moment $I_z$ about the z axis which passes through the center of gravity G, and which is perpendicular to the upper and lower surfaces of the flat plate. As is shown in FIG. 6, this flat plate is assumed to have a shape in which the length L in the longitudinal direction is greater than the width W, and the width W is greater than the thickness T. In this case, the size relationship of the respective inertial moments about the three principal axes of inertia is clearly $I_z>I_y>I_x$. In other words, $I_z$ is has the largest value, $I_y$ has the next largest value, and $I_x$ has the smallest value.

It is seen from the above conclusion that in the case of rotation about the axis in which the inertial moment shows the maximum or minimum value (among the three principal axes of inertia), the object rotates stably "as is", while in the case of rotation about the axis in which the inertial moment shows neither the maximum nor minimum value (among the three principal axes of inertia), rotation occurs about all of the three principal axes of inertia, so that the rotation is unstable. When this is applied to the abovementioned flat plate, the following results are obtained. A case is considered in which this flat plate is rotated about one of the three principal axes of inertia, i.e., the x axis, y axis or z axis, and is projected into space. If the initial rotation is rotation about either x axis or z axis, the flat plate continues to perform stable rotation. On the other hand, if the initial rotation is rotation about the y axis, the rotational motion immediately becomes irregular, so that rotation occurs about all of the three principal axes of inertia.

In the present invention, it was discovered that this fact can be applied to a golf putter head. Here, three mutually perpendicular axes, i.e., a first axis A1, second axis A2 and third axis A3, are defined as shown in FIG. 1 in relation to a golf putter head. The first axis A1 is an axis which passes through the center of gravity of the head, and which is parallel to the face surface and the horizontal plane described above, in a state in which this head is placed on this horizontal plane at a specified lie angle and loft angle (hereafter also referred to as the "standard state" or the like). Accordingly, the first axis A1 is an axis which passes through the center of gravity of the head in the toe-heel direction. The second axis A2 is an axis in the vertical direction to said horizontal plane which passes through the center of gravity of the head in the standard state. The third axis A3 is an axis which passes through the center of gravity of the head, and which is perpendicular to the first axis and perpendicular to the second axis. Accordingly, the third axis A3 is an axis which passes through the center of gravity of the head in the face—back face direction.

In a putting stroke, the head performs a rotational motion along with the linear advancing motion. In this stroke, especially in the take-back, it may be said that the rotational motion of the head is mainly a rotation that is close to a rotation about the second axis (among the above-mentioned three axes, i.e., first axis A1, second axis A2 and third axis A3). The reasons for this are as follows.

Not only in putting strokes, but also in ordinary full shots and the like, the head unavoidably rotates about the axis of the shaft. In other words, when the golfer swings, it is impossible to swing without altering the orientation of the face surface, because of the structure of the swing; accordingly, the head rotates about the axis of the shaft. Consequently, the head undergoes rotation about the second axis A2. Furthermore, in cases where the club is swung with a large swinging width as in ordinary shots such as driver shots, iron shots and the like, and especially in shots that are close to a full shot or the like, the attitude of the head varies greatly, so that the rotation about the first axis A1 and third axis A3 is also relatively large. In a putting stroke, on the other hand, the swinging width is small; accordingly, the rotation about the first axis A1 and rotation about the third axis A3 are relatively small, and are smaller than the rotation about the second axis A2. Consequently, the rotation of the head in a putting stroke may be viewed as being mainly rotation that is close to rotation about the second axis A2.

In the present invention, since the second moment which is the inertial moment about the second axis A2 is made smaller than the first moment which is the inertial moment about the first axis A1 and the third moment which is the inertial moment about the third axis A3, the rotation of the head about the second axis A2 which is the reference axis of the second moment is stabilized; as a result, the rotation of the head during the stroke is stabilized. If the rotation of the head during the stroke is stabilized, then the behavior of the head is stabilized; accordingly, the track of the stroke is also stabilized, so that a smooth stroke is possible. Furthermore, the rotation about the second axis A2 causes a variation in the orientation of the face at the time of impact; since this rotation is stabilized, the orientation of the face at the time of impact is stabilized, so that a stroke with high reproducibility is made possible.

Furthermore, during take-back, and especially at the initial point in time of take-back, the swinging width is extremely small; accordingly, the rotation about the first axis A1 and third axis A3 is even smaller. As a result, the rotation about the second axis A2 may be viewed as accounting for an especially large proportion of the rotation in relative terms. Meanwhile, the starting time of the stroke refers to the point in time at which there is a shift from the addressing attitude in a stationary state to the swing in an active state; such a shift from stationary to active is said to be a difficult aspect of the stroke. Accordingly, it may be said that the question of whether or not it is possible to shift smoothly from the stationary state to the active state during take-back is extremely important in terms of achieving a smooth stroke. The present invention is especially effective at the starting point in time of take-back; accordingly, the present invention smoothes the transition from the addressing attitude in a stationary state to the swing in an active state, so that a smoother stroke can be achieved.

Furthermore, the three axes mentioned above, i.e., the first axis A1, second axis A2 and third axis A3, do not ordinarily coincide completely with the principal axes of inertia; in approximate terms, however, the conclusions from the abovementioned equations of Euler may be viewed as being applicable. Furthermore, by taking such an approach, it is possible to explain the test results obtained in the embodiments described later.

In the present invention, it is sufficient if the second moment is smaller than the first moment and third moment; however, it is desirable that the value obtained by subtracting the second moment from the inertial moment that is the smaller of the first and third moments be 250 g·cm$^2$ or greater; furthermore, it is more desirable that this value be 400 g·cm$^2$ or greater, and even more desirable that this value be 900 g·cm$^2$ or greater. As the value of this difference increases, the rotational motion of the head about the second axis A2 becomes more stable. However, if this value is too large, the weight of the head becomes excessively large, and there may be cases in which a strange feeling is generated in the shape of the head. Accordingly, this value s preferably 1500 g·cm$^2$ or less. Furthermore, the weight of the putter head is ordinarily about 300 g to 360 g.

Furthermore, the value of the second moment is preferably 1000 g·cm$^2$ or greater, more preferably 1100 g·cm$^2$ or greater, and even more preferably 1200 g·cm$^2$ or greater. If this value is too small, the orientation of the face surface 2 when the ball is hit tends to vary, and the sweet area tends to be reduced in size. On the other hand, if this value is too large, it becomes difficult to minimize the value of the second moment, or the value of the abovementioned difference (i.e., the value obtained by subtracting the second moment from the inertial moment that is the smaller of the first and third moments) tends to be reduced. Accordingly, the value of the second moment is preferably 2100 g·cm$^2$ or less, and is even more preferably 1800 g·cm$^2$ or less.

There are no particular restrictions on the material of the head; materials that are ordinarily used for golf putter heads may be used. For example, brass, iron alloys such as soft iron or the like, stainless steel, aluminum alloys, titanium, titanium alloys or the like may be appropriately used as the material of the head main body. Among these materials, brass, which has good workability, and stainless steel, which has good corrosion resistance, are especially suitable for use. These materials may be used singly, or may be used as composite materials. Furthermore, in cases where a weight member which has a larger specific gravity than the head main body is used, brass, tungsten or tungsten alloys such as W—Ni, W—Cu or the like may be used as the material of this weight member. Furthermore, an insert made of a resin, rubber, elastomer, copper or the like may be installed in the face surface.

EMBODIMENTS

The effect of the present invention was confirmed by means of embodiments. In the respective embodiments, a head configuration similar to that of the head shown in FIGS. 1 through 5 was used, and the heads of Embodiments 1 through 6 were manufactured by variously altering the head width Wh, head length Lh, material (specific gravity) of the head main body, presence or absence of a weight member with a specific gravity larger than that of the head main body, and material (specific gravity) and disposition position of such a weight member. These heads were compared with Conventional Examples 1 through 13. The Conventional Examples 1 through 13 are all commercially marketed products. The results obtained in comparative testing of these heads are shown in Table 1.

Testing was performed for two items, i.e., a feeling test and measurement of the face angle at the time of impact, with the same shaft and the same grip mounted on all of the embodiments and conventional examples. In the feeling test, golfers performed putting actually, and evaluated the examples using a 5-point method. Specifically, the examples were evaluated by a method in which each tester assigned a point score in five grades ranging from 1 to 5 points, with a higher point score being assigned to examples in which the stroke was felt to be smoother, and a lower point score being assigned to examples in which the stroke was felt to be less smooth. Furthermore, a total of 20 testers were used, with handicaps ranging from 5 to 15, and the numerical values obtained by averaging the evaluations of the 20 testers were taken as the evaluation values.

The face angle at the time of impact was taken as the mean value of data measured by a total of 20 testers with handicaps ranging from 5 to 15, with the distance to the target set at 1 m, and each tester putting three times. Specifically, the evaluation value for each head is the mean value for 60 data points. The measurement of this angle was accomplished by a method in which the state of the head immediately prior to impact in the actual putting stroke was photographically imaged from above, and the angle of the face surface was read from the resulting photograph. The angle was taken as 0 degrees in cases where the face surface was at right angles with respect to the target; in cases where the face surface had an angle from this right-angle direction, this angle was measured. The value of the angle was measured as a plus value whether the face surface was open or closed with respect to the target.

TABLE 1

[CE = Conventional Example, EM = Embodiment]

| | I1 (g · cm$^2$) | I2 (g · cm$^2$) | I3 (g · cm$^2$) | Feeling Evaluation | Face Angle at Impact (Deg) | (Smaller of I1 and I3-I2) (g · cm$^2$) |
|---|---|---|---|---|---|---|
| CE 1 | 1764 | 4140 | 5437 | 2.1 | 3.4 | −2376 |
| CE 2 | 1743 | 4146 | 4825 | 3.0 | 3.0 | −2403 |
| CE 3 | 1703 | 4609 | 5448 | 2.8 | 3.1 | −2906 |
| CE 4 | 841 | 3474 | 4825 | 2.1 | 3.3 | −2633 |
| CE 5 | 984 | 4228 | 4992 | 3.0 | 2.9 | −3244 |
| CE 6 | 1266 | 4723 | 5334 | 3.0 | 2.9 | −3457 |
| CE 7 | 1569 | 4357 | 4679 | 3.1 | 3.2 | −2788 |
| CE 8 | 995 | 3371 | 4330 | 2.8 | 3.0 | −2376 |
| CE 9 | 1466 | 3358 | 6556 | 1.7 | 4.6 | −1892 |
| CE 10 | 2235 | 4089 | 5647 | 2.0 | 3.4 | −1854 |
| CE 11 | 907 | 4040 | 4100 | 3.3 | 3.2 | −3133 |
| CE 12 | 2120 | 4448 | 4709 | 3.2 | 3.1 | −2328 |
| CE 13 | 1820 | 3824 | 5020 | 2.5 | 3.3 | −2004 |
| EM 1 | 1406 | 1131 | 1250 | 4.0 | 2.1 | 119 |
| EM 2 | 1735 | 1298 | 1680 | 4.1 | 1.7 | 382 |
| EM 3 | 3250 | 2015 | 2269 | 4.1 | 1.7 | 254 |
| EM 4 | 3698 | 1035 | 3013 | 4.6 | 0.9 | 1978 |
| EM 5 | 2850 | 1215 | 2008 | 4.2 | 1.5 | 793 |
| EM 6 | 2871 | 1758 | 2663 | 4.4 | 1.2 | 905 |

The measurement of the first through third moments was accomplished using an inertial moment measuring device called MODEL NUMBER RK/005-002 manufactured by INEATIA DYNAMICS, INC. The measurements were performed with the heads fixed in place by means of clay so that the respective axes of the heads coincided with the rotational axis of the inertial moment measuring device. The measurement procedure was as follows: namely, the inertial moment was first measured in a state in which the head was fixed in place by means of clay; next, the head was removed in such a manner that there was no change in the shape of the clay, and the inertial moment of the clay alone was measured. The inertial moment of the head alone was calculated from these values.

In Table 1, the first moment is designated as I1, the second moment is designated as I2, and the third moment is designated as I3. As is shown in this Table 1, the inequality I3>I2>I1 holds true in the Conventional Examples 1 through 13, which are commercially marketed products. Specifically, in all of the conventional examples, the third moment I3 is largest, the second moment I2 is next largest, and the first moment I1 is smallest. On the other hand, the inequality I1>I3>I2 holds true in all of Embodiments 1 through 6. Specifically, in all of the embodiments, the first moment I1 is largest, the third moment I3 is next largest, and the second moment I2 is smallest.

In regard to the feeling evaluation, all of the embodiments show higher feeling evaluation points than all of the conventional examples. It is thought that the reason for this is that the rotation of the head about the second axis A2 is more stabilized in the embodiments than in the conventional examples, so that the behavior of the head during the stroke is more stabilized, and the stroke is smoother. Furthermore, in all of the embodiments, the face angle at the time of impact is smaller than in the conventional examples. This means that at the time of impact, the face surface faces the target more accurately in the embodiments than in the conventional examples. The rotation of the head about the second axis A2 causes a great variation in the orientation of the face; however, since the rotation of the head about the second axis A2 is more stabilized in the embodiments than in the conventional examples, the face angle at the time of impact is more stable. Accordingly, results in which the face surface faced the target were obtained.

Figure 7:
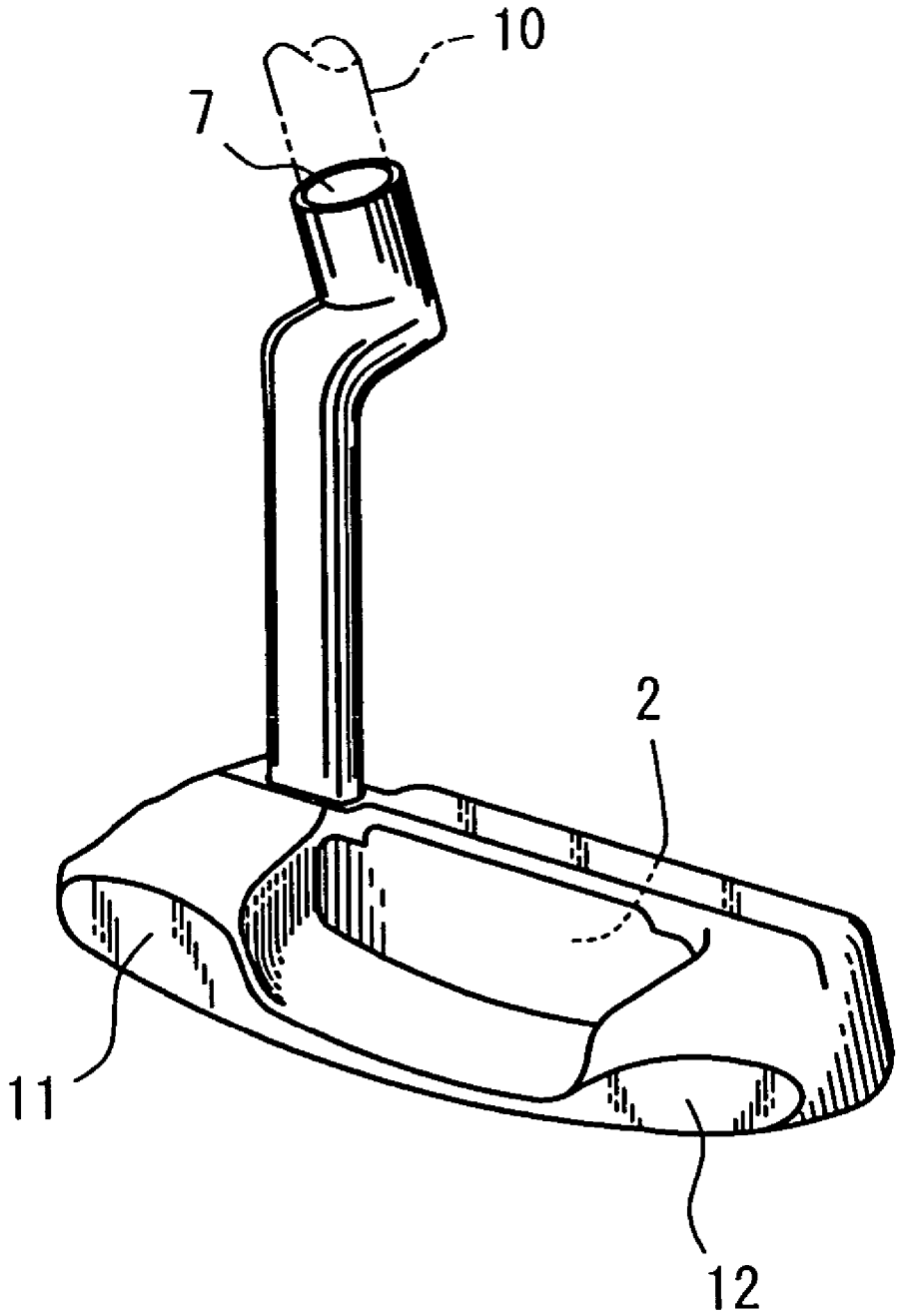
FIG. 7 is a perspective view of a conventional golf putter head.

Furthermore, for example, so-called toe-heel balance type putter heads such as that shown in FIG. 7 are widely known as conventional golf putter heads. In heads of this type, an expansion of the sweet area is accomplished by concentrating the weight in the toe part 12 and heel part 11 so that rotation of the head at the time of impact is suppressed. In cases where the weight is concentrated on the toe side and heel side of the head, the second moment about the second axis A2 is increased along with the third moment about the third axis A3 compared to cases in which the weight is uniformly distributed from the toe side to the heel side. On the other hand, the first moment about the first axis A1 is smaller than the second moment.

Figure 8:
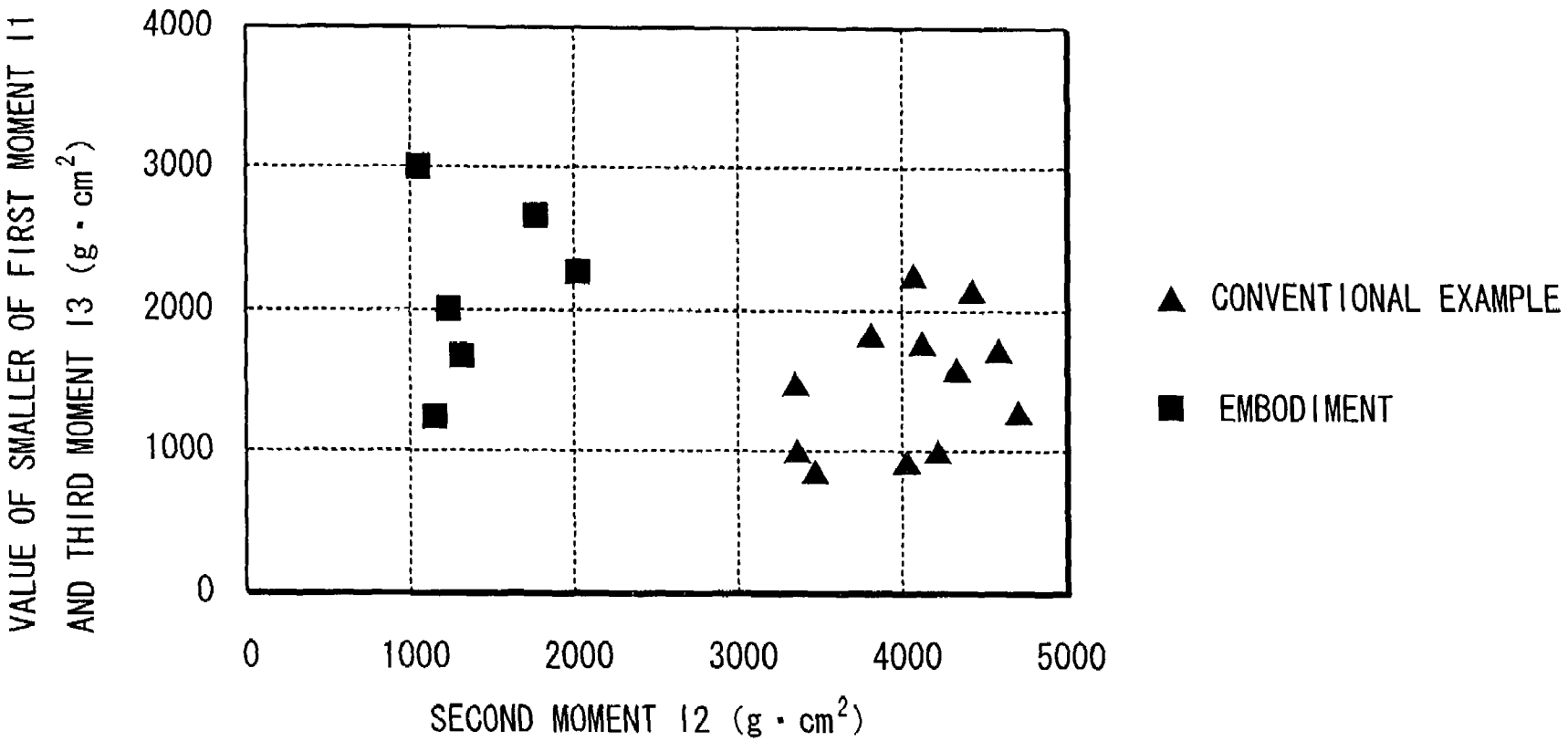
FIG. 8 is a graph plotting the inertial moment values for each of Embodiments 1 through 6 and Conventional Examples 1 through 13.

FIG. 8 is a distribution graph plotted for the above-mentioned Embodiments 1 through 6 and Conventional examples 1 through 13. The horizontal axis shows the value of the second moment I2 $g \cdot cm^2$, and the vertical axis shows the value of the smaller moment of the first and third moments I1 and I3 $g \cdot cm^2$. In conventional putter heads, the second moment is not the smallest moment. Furthermore, in conventional heads, the first moment is conspicuously smaller than the second moment. Accordingly, as is clear from FIG. 8, the distribution of the inertial moments is very different in the conventional examples and embodiments.

Thus, in conventional putter heads, the second moment is not smaller than the third moment and first moment. The reasons for this may possibly be influenced by the fact that in conventional heads, the head length Lh is generally greater than the head height Hh, the head length Lh is generally greater than the head width Wh and the like. Conventionally, no consideration has been given to the three axes of the first through third moments; there has naturally likewise been no consideration of the mutual magnitude relationship of the first through third moments. The present invention stipulates this magnitude relationship.

What is claimed is:

1. A golf putter head having a heel, a toe and a face surface for hitting a ball, the head having a weight distribution that establishes first, second and third inertial moments of the head about three axes passing through the center of gravity of the head in a state in which the head is placed on a horizontal plane at a specified lie angle and loft angle, wherein:

the first inertial moment occurs about a horizontal axis which extends along the direction between the heel and the toe, passes through the center of gravity of the head and is parallel to the face surface;

the second inertial moment occurs about a vertical axis which passes through the center of gravity of the head;

the third inertial moment occurs about an axis which passes through the center of gravity of the head and is perpendicular to said first and second axes; and wherein the second inertial moment is (1) smaller than the first inertial moment and (2) smaller than the third inertial moment.

2. The golf putter head according to claim 1, wherein the value obtained by subtracting the second inertial moment from the smaller of the first and third inertial moments is in the range from 250 $g \cdot cm^2$ to 1500 $g \cdot cm^2$.

3. The golf putter head according to claim 1, wherein the value obtained by subtracting the second inertial moment from the smaller of the first and third inertial moments is in the range from 900 $g \cdot cm^2$ to 1500 $g \cdot cm^2$.

4. The golf putter head according to claim 1, wherein the second inertial moment is in the range from 1000 $g \cdot cm^2$ to 2100 $g \cdot cm^2$.

5. The golf putter head according to claim 1, wherein the height of the putter head, measured between a top and a sole thereof, is greater that the length of the putter head, measured between the heel and the toe.

* * * * *